US007931221B2

(12) United States Patent
Kolleth

(10) Patent No.: US 7,931,221 B2
(45) Date of Patent: Apr. 26, 2011

(54) MOBILE CRUSHER UNIT

(75) Inventor: Horst Kolleth, Duisburg (DE)

(73) Assignee: ThyssenKrupp Fördertechnik GmbH, Essen (DE)

( * ) Notice: Subject to any disclaimer, the term of this patent is extended or adjusted under 35 U.S.C. 154(b) by 193 days.

(21) Appl. No.: 12/307,160

(22) PCT Filed: Aug. 23, 2007

(86) PCT No.: PCT/EP2007/007399

§ 371 (c)(1),
(2), (4) Date: Dec. 31, 2008

(87) PCT Pub. No.: WO2008/031490

PCT Pub. Date: Mar. 20, 2008

(65) Prior Publication Data

US 2009/0189003 A1 Jul. 30, 2009

(30) Foreign Application Priority Data

Sep. 11, 2006 (DE) ..... 102006043268

(51) Int. Cl.
*B02C 21/02* (2006.01)

(52) U.S. Cl. ..... 241/101.74

(58) Field of Classification Search ..... 241/101.74, 241/101.741

See application file for complete search history.

(56) References Cited

U.S. PATENT DOCUMENTS 7,182,284 B2 * 2/2007 Jabs et al. ..... 241/101.74

FOREIGN PATENT DOCUMENTS

| | | |
|---|---|---|
| AT | 388 968 | 9/1989 |
| DE | 36 08 789 | 9/1987 |
| WO | WO 2004/087324 | 10/2004 |

* cited by examiner

*Primary Examiner* — Mark Rosenbaum
(74) *Attorney, Agent, or Firm* — McGlew and Tuttle, P.C.

(57) ABSTRACT

A mobile crusher unit is provided having a supporting framework (12) which is includes at least a crusher unit (13), a feed conveyor (11), and a dumping conveyor unit (14), and which can be relocated by means of a crawler undercarriage. To minimize construction height and weight the supporting framework and the traveling gear are configured as one unit, with parts of the supporting framework (12) serving as parts of the traveling gear, and with the crawlers (16) of the crawler vehicle protruding into recesses of the supporting framework.

18 Claims, 2 Drawing Sheets

MOBILE CRUSHER UNIT

CROSS REFERENCE TO RELATED APPLICATIONS

This application is a United States National Phase application of International Application PCT/EP2007/007399 and claims the benefit of priority under 35 U.S.C. §119 of German Patent Application DE 10 2006 043 268.1 filed Sep. 11, 2006, the entire contents of which are incorporated herein by reference.

FIELD OF THE INVENTION

The invention relates to a mobile crusher unit having a supporting framework which is comprised of at least one crusher unit, a feed conveyor, and a discharge conveyor unit mounted thereto, and which can be relocated by means of a crawler undercarriage.

BACKGROUND OF THE INVENTION

Mobile crusher units of the type described hereinabove are needed to reduce loose material such as ore, rock, coal or oil slate to a desired grain size.

The German DE 36 08 789 C2 describes a mobile crusher unit having a supporting framework that receives at least one crusher, and that can be lifted and relocated, in accordance with the advance of the removal of material, by a transport mechanism, preferably a walking-leg system or an extendable crawler or wheel undercarriage, and having at least one charging device which is associated with one crusher, and having a receiving hopper for the loose material delivered by freely transporting loading machines such as wheel loaders or excavators, and having a conveyor which feeds the loose material to a transfer hopper of the crusher. The feeding device is required to be mounted in an arrangement swivable around a vertical axis at the supporting framework even during working mode.

Preferably used as crushers are roller-type crushers, -impact crushers, swing-hammer crushers, cone crushers, jaw crushers or gyratory crushers. Installed downstream of the crusher is a discharge conveyor unit which is composed of a discharge conveyor situated beneath the crusher and a dumping conveyor co-acting with the discharge conveyor, with it being possible for the latter unit to be of a mobile configuration with regard to the supporting framework. An embodiment of this kind has a drawback in that it has a relatively large mass owing to the use of the additional discharge conveyor. This additional discharge conveyor requires a drive and maintenance. Moreover, implementing this discharge conveyor adds on the weight of the mobile crusher unit, which is to be considered in the layout of the undercarriage motor power. To solve the task of increasing the economic efficiency of a mobile crusher, and more particularly to diminish the need for service and maintenance and to improve its adaptability to different working conditions, WO 2004/087324 proposes to install downstream of the crusher unit only one dumping conveyor unit which is used both for the discharge and for the dumping procedure, and which in terms of the supporting framework is designed and built as a component group that is swingable in horizontal and vertical direction. Both the feed conveyor unit and the dumping conveyor unit can be configured as a plate-type belt, chain conveyor or belt conveyor. The swing movements of the dumping conveyor unit should be triggered by means of any optional drive, more particularly by means of hydraulic or electro-mechanical drives.

These crusher units or similar ones are comprised of a traveling gear which carries a bogie on which the supporting framework is mounted in a pivotable arrangement. A disadvantage of such a structure is its relatively great construction height which necessitates a correspondingly long feed conveyor whose lower position is determined by the fact that the material to be crushed is discharged from wheel loaders, excavators or dumping trucks, for example. Another drawback lies in the high mass resulting hereof.

Out of AT 388 968 B is known a portable crusher unit for transporting the material over feeding hoppers, sieves, first conveyors and crushing devises to the last conveyor. All these elements are mounted on a common frame, which contains means of crawler undercarriage.

SUMMARY OF THE INVENTION

Now, therefore, the present invention has the object of further developing a mobile crusher unit of the kind mentioned hereinabove so as to create the lightest possible construction form while ensuring high stiffness. This task is solved by the mobile crusher unit according to the present invention which comprises supporting framework and traveling gear configured as a unit, with parts of the traveling gear serving as parts of the supporting framework, and with the crawlers of the traveling gear protruding into recesses and/or clearances of the supporting framework. This measure particularly leads to a smaller height of construction which results from the fact that the traveling gear girder is merged with the supporting framework for the crusher unit, feed conveyor and dumping conveyor to one unit. Furthermore, the gyratory arrangement provided according to prior art technology between the traveling gear and the supporting framework is deleted. The low construction height also leads to the possibility that the feed conveyor whose maximum inclination is functionally limited can be built shorter so that the overall length of the mobile crusher unit is also reduced. By taking the afore-mentioned measures, substantial weight is also saved which allows for a less costly fabrication of mobile crusher units. The lower weight of the crusher unit also facilitates the shunting capability so that an omission of a gyratory and/or swiveling unit is not significant. Likewise, only one drive is needed for the crawler undercarriage which is completely integrated in the supporting framework structure.

The supporting framework can be configured as a solid full profile or in a trusswork structure, with the latter leading to further substantial savings on weight whilst assuring sufficient stiffness.

The supporting framework is preferably comprised of a U-shaped part with horizontally lying legs on the side averted from the feed conveyor, in which the crusher unit is arranged at the upper leg whilst the dumping conveyor unit is situated at the lower leg. The supporting framework for supporting the feed conveyor which follows next to the upright standing basis of the U-shaped part is basically configured in form of a triangle. In other words, the whole supporting structure forms a uniform body which is geometrically composed of a triangular and a U-shaped part. The dumping conveyor unit is preferably supported on the lower leg of the U-shaped part in such a manner that it can be swiveled around a vertical axis, i.e. in horizontal direction by up to 120°, and around a horizontal axis, proceeding from a horizontal position, by ±20° to the top or bottom, respectively. The dumping conveyor unit is so configured that it takes-up the material falling out from the crusher unit at a point which simultaneously lies on the vertical gyratory axis for the horizontal swiveling of the dumping conveyor. Hereby it is possible, without relocating the dumping conveyor, to dump the crushed loose material at any place lying on the pitch circle arch which results by the length of the dumping conveyor. Moreover, by modifying the inclination of the dumping conveyor, even further dumping conditions can be taken account of, for example floor irregularities in the area of a mobile crusher unit and dumping point of the dumping conveyor as well as dumping on other belt conveyors.

The integration of the traveling gear can preferably be so configured that the lower leg of the U-shaped part of the supporting framework is part of the traveling gear for the crawler arranged in this area.

As one knows in principle from prior art technology, a feed tank is situated in the bottom area of the feed conveyor which is preferably fastened to the supporting framework.

The mobile crusher unit has special advantages if the direction of travel determined via the crawler arrangement lies transversely to the longitudinal axis of the crusher unit. Hereby, the circumstance is taken account of in that an excavator excavates rock, ore or coal basically along an excavation route directed in parallel to the direction of travel of the crusher unit, so that the loose material is continually obtained along a line parallel to the direction of travel, along which the crawler undercarriage can travel without shunting operations.

Other advantages and embodiments of the present invention become evident from the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
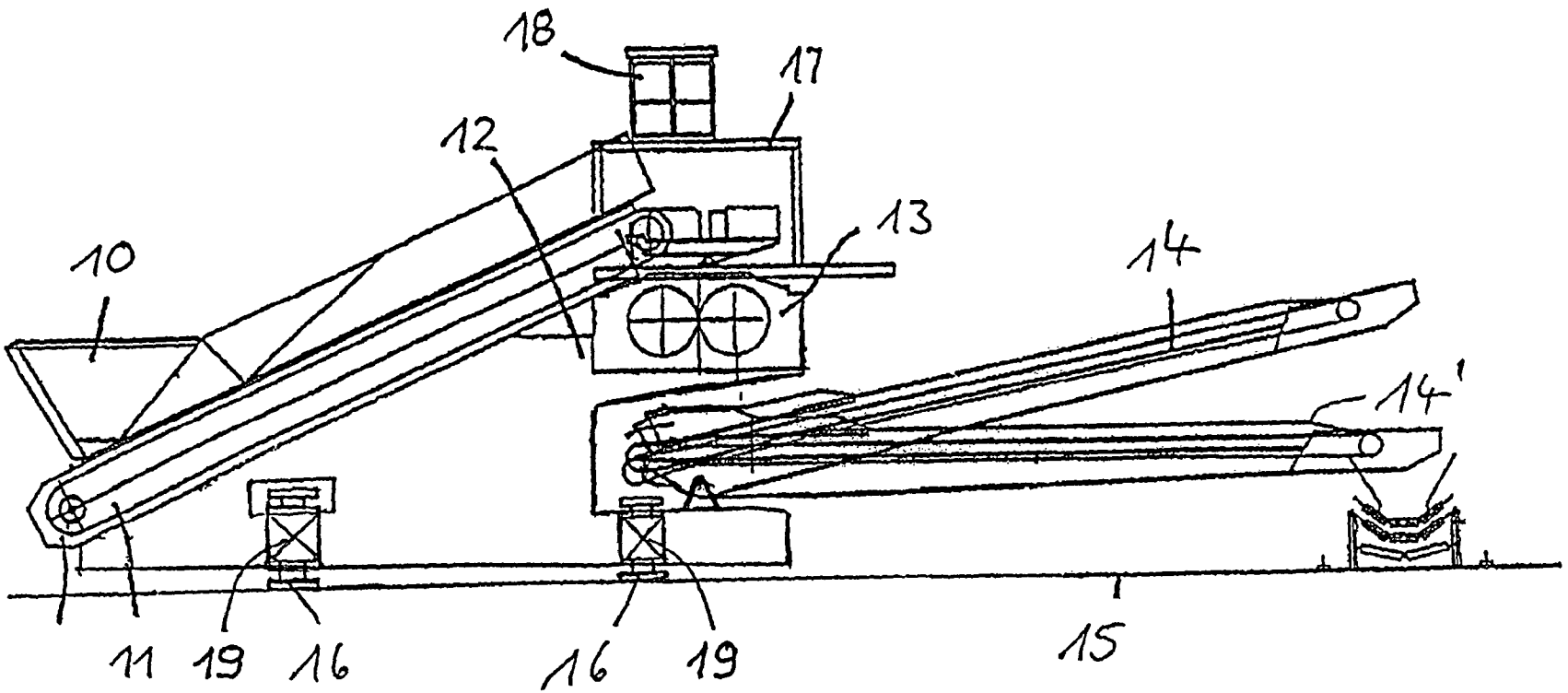
FIG. 1 is a lateral view of an inventive mobile crusher unit according to the invention.

Referring to the drawings in particular, the crusher unit shown in FIG. 1 is basically comprised of a feed tank 10, a feed conveyor 11 in form of a feeder belt which rests on the supporting framework 12, and furthermore it is comprised of a crusher unit 13 configured as a double-roller-type crusher and a dumping conveyor unit 14 which is shown here in an up-swung position as well as with a horizontal position designated with 14'. The mobile crusher unit travels above the floor 15 by means of crawlers 16, the traveling gear girders 19 of which are integrated in the supporting framework 12. The supporting framework 12 furthermore is comprised of a built-on structure 17 on which a driver's cab 18 is situated. The mobile crusher unit can be moved vertically to the drawing plane.

Figure 2:
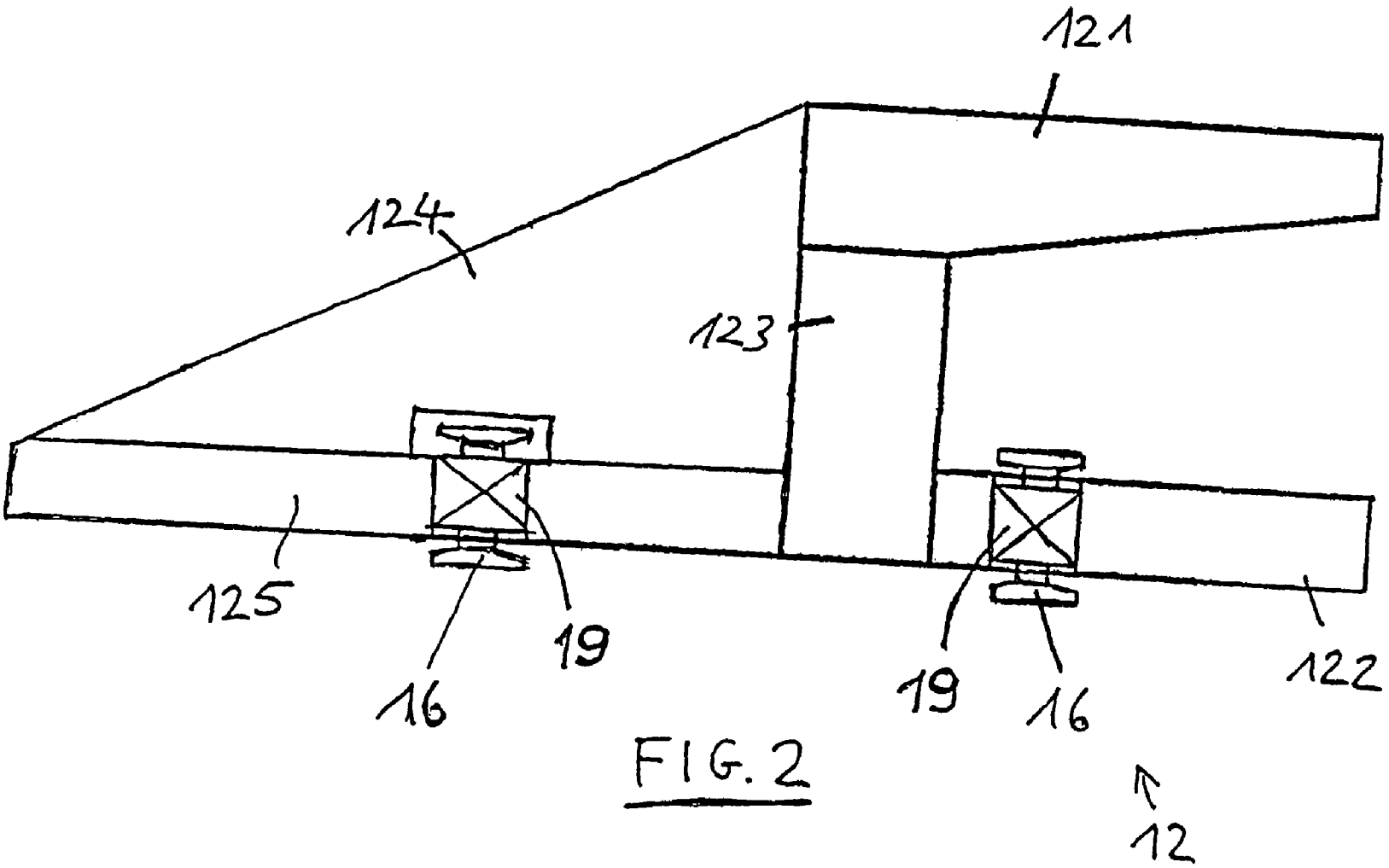
FIG. 2 is a schematic view of the supporting framework with the crawler undercarriage according to the invention.

The supporting framework 12 with the crawlers 16, the traveling gear girders 19 of which are integrated as part of the traveling gear in the supporting framework 12, is illustrated in detail in FIG. 2. The supporting body unit recognizable there is comprised of a U-shaped part with legs 121 and 122 as well as an upright-standing base 123 as well as a triangular part 124 and another body designated with reference number 125. FIG. 2 shows additionally, that the crawler 16, which is positioned on the lower leg 122 of the U-shaped supporting framework extends into the room between the horizontal lying Legs 121 and 122. As a matter of fact, parts 121 to 125 form a structural unit which in this case shown here is represented by geometrical bodies that are separated here only for the sake of clarity. Part 124, in particular, can also be configured in a trusswork construction style.

The dumping conveyor unit 14 rests on the lower leg 122 of the afore-mentioned U-shaped part, with the supporting point lying next to the constructively integrated crawler undercarriage. The double-roller-type crusher is fastened to the upper leg 121 and arranged above the dumping conveyor unit 14 which can be swiveled by ±120° both in vertical direction, as indicated in FIG. 1, and in horizontal direction, i.e. relative to a vertical gyratory axis lying in the drawing plane. It is technically achieved via a gyratory bracket.

Besides, with regard to the configuration and layout, reference is taken to the arrangement described more closely in WO 2004/087324.

While a specific embodiment of the invention has been shown and described in detail to illustrate the application of the principles of the invention, it will be understood that the invention may be embodied otherwise without departing from such principles.

The invention claimed is:

1. A mobile crusher unit, comprising:

a supporting framework;

a crusher unit supported on said supporting framework;

traveling gear with crawlers and a crawler undercarriage;

a feed conveyor supported on said supporting framework; and a dumping conveyor unit, and which can be relocated by means of said crawler undercarriage, wherein said supporting framework and said traveling gear are configured as a unit, with parts of the traveling gear serving as parts of the supporting framework, and with the crawlers of the traveling gear protruding into recesses and/or clearances of the supporting framework wherein said supporting framework is comprised of a U-shaped part with horizontally lying legs on the side averted from the feed conveyor, wherein the crusher unit is arranged at an upper leg of said horizontally lying legs and wherein said dumping conveyor unit is situated at a lower leg of said horizontally lying legs, and a portion of said supporting framework for supporting the feed conveyor is essentially configured in a form of a triangle.

2. A mobile crusher unit as defined in claim 1, wherein said supporting framework is configured as a solid full-profile or as a trusswork.

3. A mobile crusher unit as defined in claim 1, wherein said dumping conveyor unit is supported on the lower leg for being swivelled around a vertical axis, in a horizontal direction, by up to ±120°, and around a horizontal axis, proceeding from a horizontal position, by up to ±20° to the top or bottom, respectively.

4. A mobile crusher unit as defined in claim 3, further comprising:

a feed tank arranged in a lower area of the feed conveyor.

5. A mobile crusher unit as defined in claim 1, wherein said traveling gear has a traveling gear girder for the crawler arranged as an integrated part of the lower leg of the U-shaped part of the supporting framework.

6. A mobile crusher unit as defined in claim 1, further comprising:

a feed tank arranged in a lower area of the feed conveyor and fastened to the supporting framework.

7. A mobile crusher unit as defined in claim 1, wherein said crawlers provide a crawler arrangement and a direction of travel determined via the crawler arrangement lies transversely to the longitudinal axis of the crusher unit.

8. A mobile crusher unit as defined in claim 3, wherein said traveling gear has a traveling gear girder for the crawler arranged as an integrated part of the lower leg of the U-shaped part of the supporting framework.

9. A mobile crusher unit as defined in claim 1, further comprising:

a feed tank arranged in a lower area of the feed conveyor.

10. A mobile crusher unit, comprising:

a supporting framework and traveling gear configured as a unit with parts of said traveling gear defining parts of said supporting framework and with crawlers of said traveling gear extending into recesses and/or clearances of said supporting framework, said supporting framework comprising a U-shaped part with horizontally extending legs on a side opposite said feed conveyor and said traveling gear having a traveling gear part for supporting the crawler arranged as an integrated part of said lower leg of said U-shaped part of said supporting framework;

a crusher unit supported on said supporting framework;

a feed conveyor supported on said supporting framework; and a dumping conveyor unit.

11. A mobile crusher unit as defined in claim 10, wherein said supporting framework is configured as a solid full-profile frame or as a trusswork frame.

12. A mobile crusher unit as defined in claim 10, wherein, said crusher unit is arranged at an upper leg of said horizontally extending legs and wherein said dumping conveyor unit is situated at a lower leg of said horizontally extending legs, and a portion of said supporting framework for supporting the feed conveyor has a triangular shape or near triangular shape.

13. A mobile crusher unit as defined in claim 12, wherein said dumping conveyor unit is supported on the lower leg for being swivelled around a vertical axis, in a horizontal direction, by up to ±120°, and around a horizontal axis, proceeding from a horizontal position, by up to ±20° to the top or bottom, respectively.

14. A mobile crusher unit as defined in claim 13, wherein said traveling gear has a traveling gear girder for the crawler arranged as an integrated part of the lower leg of the U-shaped part of the supporting framework.

15. A mobile crusher unit as defined in claim 12, wherein said traveling gear part is a traveling gear girder for the crawler.

16. A mobile crusher unit as defined in claim 10, further comprising:

a feed tank arranged in a lower area of the feed conveyor and connected to the supporting framework.

17. A mobile crusher unit as defined in claim 10, wherein said crawlers provide a crawler arrangement and a direction of travel determined via the crawler arrangement lies transversely to the longitudinal axis of the crusher unit.

18. A mobile crusher unit comprising:

a supporting framework with a crusher unit, a feed conveyor and a dumping conveyor unit, the supporting framework comprised of a U-shaped part with horizontally lying legs on the side averted from the feed conveyor; and travelling gear with a crawler undercarriage having crawlers with which the supporting framework can be relocated, the supporting framework and the travelling gear being configured as a unit with parts of the travelling gear serving as parts of the supporting framework and with the crawlers of the travelling gear protruding into recesses and/or clearances of the supporting framework, wherein the crusher unit is arranged at the upper leg and wherein the dumping conveyor unit is situated at the lower leg and the supporting framework for supporting the feed conveyor is basically configured in form of a triangle.

* * * * *